United States Patent [19]

Takata

[11] Patent Number: 4,627,134

[45] Date of Patent: Dec. 9, 1986

[54] BALL-SIDE PIECE OF SNAP FASTENER

[75] Inventor: Akihiko Takata, Fujisawa, Japan

[73] Assignee: Scovill Japan Kabushiki Kaisha, Tokyo, Japan

[21] Appl. No.: 821,175

[22] Filed: Jan. 21, 1986

[30] Foreign Application Priority Data

Jan. 24, 1985 [JP] Japan ..... 60-7323[U]

[51] Int. Cl.[4] ..... A44B 1/38

[52] U.S. Cl. ..... 24/687; 24/108; 24/691

[58] Field of Search ..... 24/687, 688, 691, 108

[56] References Cited

U.S. PATENT DOCUMENTS

| | | | |
|---|---|---|---|
| 443,792 | 12/1890 | Pringle | 24/687 |
| 494,104 | 3/1893 | Kraetzer | 24/692 |
| 581,224 | 4/1897 | Draper | 24/687 |
| 1,583,472 | 5/1926 | King | 24/691 |
| 4,475,273 | 10/1984 | Konno | 24/108 |

FOREIGN PATENT DOCUMENTS

| | | | |
|---|---|---|---|
| 0048568 | 6/1911 | Austria | 24/681 |

*Primary Examiner*—Victor N. Sakran

*Attorney, Agent, or Firm*—Panitch Schwarze Jacobs and Nadel

[57] ABSTRACT

A ball-side piece of a snap fastener comprises two members; an inside member having a portion adapted to be in contact with one side of a fabric or the like and a guide face portion provided therearound to receive and guide curved tips, or claws, of a backing member, and an outside member extended over and secured to the periphery of the inside member. The outside member has a round head adapted to engage a socket-side piece of the snap fastener, a flat flange portion adapted to contact the same side of the fabric or the like and hold the deformed claws of the backing member as attached to the fabric or the like, and a curved guide face portion extending over the guide face portion of the inside member toward the periphery of the flat flange portion so as to receive and guide the claws of the backing member.

4 Claims, 6 Drawing Figures

BALL-SIDE PIECE OF SNAP FASTENER

BACKGROUND OF THE INVENTION

1. Field of the Invention

This invention relates to a snap fastener, and more specifically to a ball-side piece of a snap fastener.

2. Prior art

Known ball-side pieces of snap fasteners are classified into two groups by the type of attaching or backing member; one using a backing member which requires a relatively large perforation to be made in the piece of fabric or the like so as to be secured thereto, and the other using a claw type backing member which merely pierces the fabric or the like with pointed projections. The former, as illustrated in FIG. 1, employs a backing member having a cylindrical portion 4 which extends upwardly through a perforation in the fabric or the like and fits in the hollow of a round head 1 of the ball-side piece. The two are then crimped together so that the cylindrical portion is secured inside the round head with flange portions of the ball-side piece and the backing member gripping the surrounding edge of the perforation from the both sides of the fabric or the like. The flange portion 3 of the ball-side piece 1 is flat or is raised radially inwardly with a slight incline from the outer periphery. With the sloped structure, as shown in FIG. 2, the inclined portion of the flange 3 enters the cavity of a socket-side piece when the ball-side piece is engaged with the latter piece, and the overall height $h_1$ of the fastener in the fastening position is limited, generally giving a thin appearance. However, because the ball-side piece uses the backing member that extends through a large perforation formed in the fabric or the like in the manner described above, the compressive forces of the both flange portions of the ball-side piece and the backing member are sometimes not strong enough to keep the perforation from being radially enlarged by external forces, especially where the fabric or the like to which the snap fastener is attached is stretchable. On the other hand, the ball-side piece 7 that uses a claw backing member having a few clawlike projections adapted merely to pierce the fabric or the like generally has a cross section as shown in FIG. 3. It comprises a cylindrical portion in the center having an integral radial expansion in the form of a guide face portion 11 adapted to be contacted with claws 23 of a backing member shown in FIG. 4 and a flange portion 12 adapted to engage the claws 23 deformed along the guide face portion. An annular groove 10, where the flange portion 12 and the lower end of the cylindrical portion under the round head 8 meet, extends downwardly slightly below the flange portion 12 so as to coact with the backing member to grip the fabric or the like securely.

With the configuration described, the ball-side piece of this character allows the claws of the backing member to pierce even a relatively thick fabric or the like into proper engagement with the flange portion 12 by virtue of the shearing forces produced by the coaction of the guide face portion 11 and the claws. This type of ball-side piece is advantageously used on stretchable fabrics or the like because the claw backing member effectively holds the piece in position without the need of perforating the fabrics or the like.

Nevertheless, it still has shortcomings. As the sectional views of FIGS. 3 and 4 indicate, the ball-side piece is fabricated by drawing a blank of metal sheet to form the cylindrical portion first and the annular groove 9 next and then curling the rest of the blank to form the guide face portion 11 and the flange portion 12. The complexity of fabrication renders it difficult to make the flange portion 12 flat and level. When this ball-side piece is to be attached to a fabric or the like, especially a thick one, it occurs frequently that the tips of the claws piercing the fabric and exposed on the opposite side are too short to mesh adequately with the flange portion 12. The ball-side piece attached in this way would eventually separate from the backing member upon repeated engagement with and disengagement from the socket-side piece. Also, when the two pieces of the snap fastener are engaged in the fastening position, the height $a_1$ of the flange portion 12 adds to the overall height $h_2$ of the fastener to such an extent that it can pose an appearance problem, especially with fashionable fabrics or the like.

SUMMARY OF THE INVENTION

It is an object of this invention to provide a ball-side piece of a snap fastener free from the afore-described disadvantages common to the existing ball-side pieces and is superior in appearance.

Another object of the invention is to provide a ball-side piece which is securely joined with the backing member and will not easily come off from the piece of a garment or the like to which it is attached.

Still another object of the invention is to provide a ball-side piece adapted to be used together with a claw backing member to a small thickness or height when attached in place.

These objects are realized, in accordance with the invention by providing a ball-side piece comprising two members, one inside and the other outside, that is, an inside member having a portion adapted to be in contact with one side of a fabric or the like and a guide face portion provided therearound to receive and guide curved tips, or claws, of a backing member, and an outside member extended over and secured to the periphery of the inside member, said outside member having a round head adapted to engage a socket-side piece of the snap fastener, a flat flange portion adapted to contact the opposite side of the fabric or the like and hold the deformed claws of the backing member as attached to the fabric or the like, and a curved guide face portion extending over the guide face portion of the inside member toward the periphery of the flat flange portion so as to receive and guide the claws of the backing member.

BRIEF DESCRIPTION OF THE DRAWINGS

FIG. 3 is a sectional view of a conventional ball-side piece to be attached in place by the use of a claw backing member which simply pierces a fabric or the like;

DETAILED DESCRIPTION OF THE INVENTION

Figure 5:
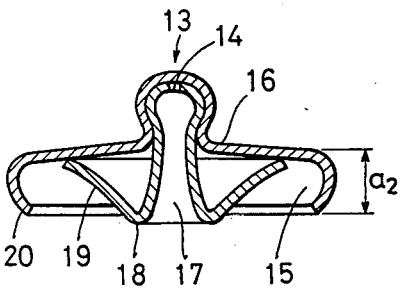
FIG. 5 is a sectional view of a ball-side piece of a snap fastener embodying the present invention.

The invention will now be described with reference to the accompanying drawings. A ball-side piece embodying the invention has a cross sectional contour as in FIG. 5. It comprises, as shown, an inside member 17 having a guide face portion 19 adapted to be in contact with one side of a piece of fabric or the like (not shown) and to guide claws of a backing member for attachment, and an outside member 15 extending over and secured to the inside member, the outside member having a round head 14 to engage a socket-side piece, designated at 21 in FIG. 6, and a flange portion 20 adapted to contact the same side of the fabric or the like, or the portion radially outside of the inside member.

Figure 1:
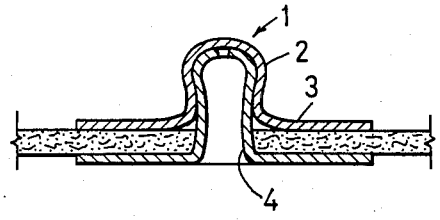
Fig. 1 PRIOR ART
FIG. 1 is a sectional view of a conventional ball-side piece of a snap fastener using a backing member which extends through a perforation made in a fabric or the like, as attached in place.
Figure 2:
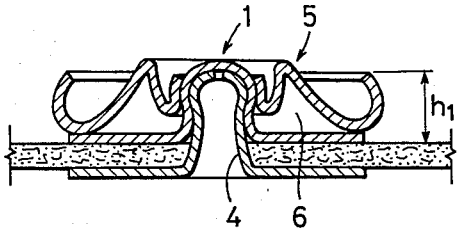
Fig. 2 PRIOR ART
FIG. 2 is a sectional view of the ball-side piece of FIG. 1 as engaged with a socket-side piece of the snap fastener.
Figure 3:
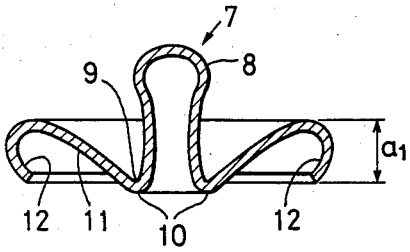
Fig. 3 PRIOR ART
Figure 4:
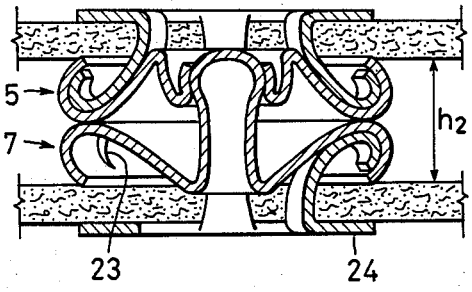
Fig. 4 PRIOR ART
FIG. 4 is a sectional view of the ball-side piece of FIG. 3 as attached to a fabric or the like and engaged with a similarly attached socket-side piece.

The construction described above eliminates the need of forming a groove as indicated at 9 in FIG. 3. Thus, the flange portion 20 can be made flat and level without involving technical difficulty or complexity of fabrication. This enables the claws of the backing member to pierce a relatively thick fabric or the like to engage the flange portion securely.

Figure 6:
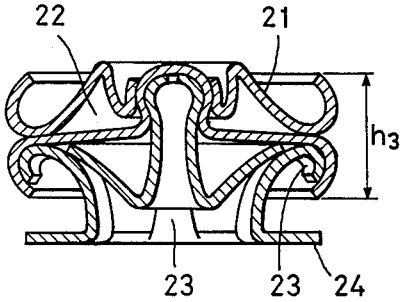
FIG. 6 is a sectional view of the ball-side piece of the invention as attached to a fabric or the like (not shown) with the aid of a claw backing member and engaged with a socket-side piece.

Because the flange portion 20 is flattened, the height $a_2$ of the flange portion 20 is less than the usual height. A shoulder portion 16 between the round head 14 and the flange portion 20 of the outside member 15 is inclined with a slight ascent radially inwardly, similarly to the conventional ball-side piece using a backing member that extends through a perforation in the fabric or the like. Consequently, as shown in FIG. 6, the ball-side piece of the invention is characterized in that the shoulder portion partly enters the cavity of the socket-side piece.

According to this invention, therefore, there is no such annular groove 9 characteristic of the conventional ball-side piece using an ordinary claw backing member and that is seen when the ball-side piece is attached to a fabric or the like. The overall height $h_3$ of the ball-side piece and socket-side piece in engagement is less than that of the conventional couple, and hence the snap fastener gives a simple appearance that does not mar the fashionable appeal of the product to which the fastener is attached. Moreover, the ball-side piece provided by the invention may use a claw backing member 24 for its attachment that does not necessitate perforation of the fabric or the like and maintains a firm grip of even a stretchable fabric or the like.

While the invention has been described with reference to a preferred embodiment thereof, it is to be distinctly understood that various changes and modifications may be made without departing from the spirit and scope of the invention.

What is claimed is:

1. A ball-side piece of a snap fastener comprising an inside member having a portion adapted to be in contact with one side of a fabric or the like and a guide face portion provided therearound to receive and guide curved tips, or claws, of a backing member, and an outside member extended over and secured to the periphery of the inside member, said outside member having a round head adapted to engage a socket-side piece of the snap fastener, a flat flange portion adapted to contact the one side of the fabric or the like and hold the deformed claws of the backing member as attached to the fabric or the like, and a curved guide face portion extending over the guide face portion of the inside member toward the periphery of the flat flange portion so as to receive and guide the claws of the backing member.

2. A ball-side piece according to claim 1 wherein said inside member has a cylindrical portion formed in the center the lower end of which extends integrally and smoothly toward said portion for contacting the fabric or the like, and said round head of said outside member is securely fitted to said cylindrical portion.

3. A ball-side piece according to claim 1 wherein said inside member comprises, in one piece, a cylindrical portion in the center, a contacting portion formed around the lower end of the cylindrical portion and protruding toward the fabric or the like, and a guide portion extending obliquely upwardly from the contacting portion to receive and guide the claws of said backing member, and said outside member comprises, in one piece, said round head secured to said cylindrical portion, a portion extending gently downwardly from said round head, a portion smoothly extending from the periphery of the downwardly extending portion further downwardly and thence inwardly, and a flat flange portion further extending inwardly therefrom.

4. A ball-side piece according to claim 3 wherein said cylindrical portion is bulged at the top to fit in the hollow of said round head.

* * * * *